United States Patent [19]

Baur

[11] 4,291,739

[45] Sep. 29, 1981

[54] METHOD OF MANUFACTURING A HOLLOW CASTING MOLD

[76] Inventor: Eduard Baur, Post Hommerich, 5256 Waldbruch, Fed. Rep. of Germany

[21] Appl. No.: 67,555

[22] Filed: Aug. 16, 1979

[51] Int. Cl.[3] ..... B22C 9/04

[52] U.S. Cl. ..... 164/5; 164/7.1; 164/34; 164/246

[58] Field of Search ..... 164/7, 34–36, 164/45, 235, 246, 249, 160, 97, 5

[56] References Cited

U.S. PATENT DOCUMENTS

| | | | |
|---|---|---|---|
| 3,010,852 | 11/1961 | Prange et al. | 164/35 |
| 3,498,360 | 3/1970 | Wittmoser et al. | 164/34 |
| 3,861,447 | 1/1975 | Hondo | 164/34 |

FOREIGN PATENT DOCUMENTS

| | | | |
|---|---|---|---|
| 1144882 | 3/1963 | Fed. Rep. of Germany | 164/34 |
| 1508939 | 9/1969 | Fed. Rep. of Germany | 164/97 |
| 50-30011 | 9/1975 | Japan | 164/7 |
| 50-37606 | 12/1975 | Japan | 164/34 |
| 51-52928 | 5/1976 | Japan | 164/7 |
| 53-34563 | 9/1978 | Japan | 164/160 |
| 208900 | 1/1968 | U.S.S.R. | 164/35 |

*Primary Examiner*—Robert D. Baldwin
*Assistant Examiner*—K. Y. Lin
*Attorney, Agent, or Firm*—Michael J. Striker

[57] ABSTRACT

A method of manufacturing a casting mold includes the steps of forming a casting mold body of a flowable binder-free backfilling material, stabilizing the casting mold body by negative pressure, and providing in the body a lost form of synthetic plastic material, particularly foamed synthetic plastic material.

12 Claims, 11 Drawing Figures

FIG.1
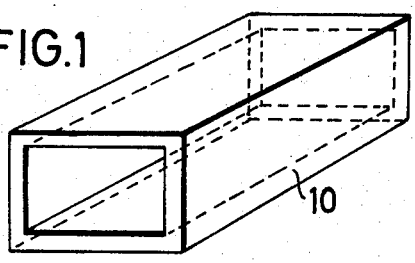
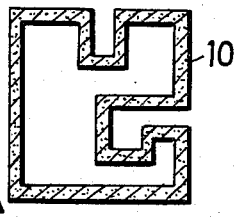
FIG.1A
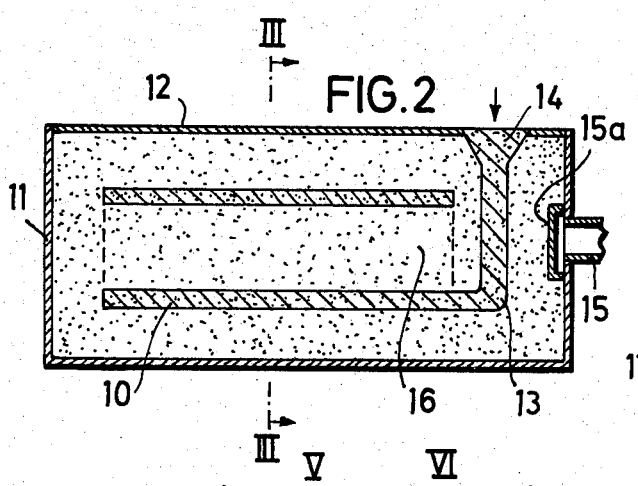
FIG.2
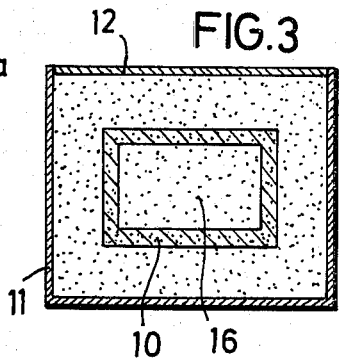
FIG.3
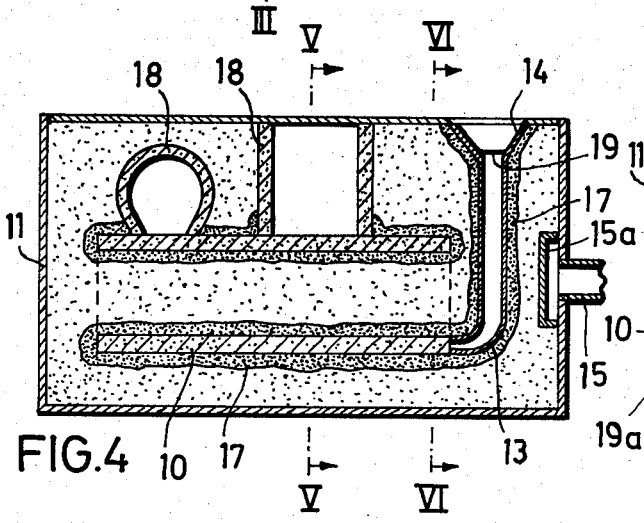
FIG.4
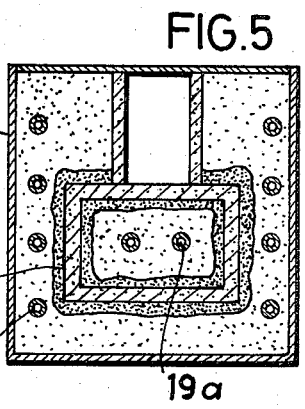
FIG.5
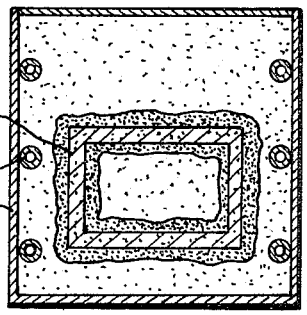
FIG.6

METHOD OF MANUFACTURING A HOLLOW CASTING MOLD

BACKGROUND OF THE INVENTION

The present invention relates to a method of manufacturing a casting mold of a flowable, binder-free backfilling material, stabilized by negative pressure.

It is known to utilize lost forms of foamed synthetic plastic material for manufacturing of cast parts. These forms are surrounded by sand provided with binding medium. Into the foamed synthetic plastic form molten metal is introduced so as to vaporize the form and to occupy its place. This technique, known as the full mold process, is widely utilized. However, it has the disadvantage that the outer face of the final cast part is rough and many cores are necessary.

It has been proposed to pour the foamed synthetic plastic form in a binder-free sand. This method has the disadvantages that during the vaporization of the foamed synthetic plastic material a strong shrinkage of the form takes place and thereby the dimensions of the cast parts do not correspond to the initial dimensions of the form.

SUMMARY OF THE INVENTION

Accordingly, it is an object of the present invention to provide a method of manufacturing of a hollow casting mold, particularly stabilized by negative pressure, which avoids the disadvantages of the prior art.

More particularly, it is an object of the present invention to provide a method in accordance with which burnable or vaporizable forms of synthetic plastic material are utilized, so as to produce with relatively low technical expenditures cast parts having correct dimensions and smooth outer surfaces and so that, due to the omission of cores, cast parts may be produced which are of complicated spacial construction.

In keeping with these objects and with others which will become apparent hereinafter, one feature of the present invention resides, briefly stated, in a method of manufacturing a negative pressure-stabilized cast mold of flowable binder-free backfilling material, in which a lost vaporizable or burnable form of synthetic plastic material is utilized as a form. Particularly, the lost form may be constituted of foamed synthetic plastic material.

In accordance with the present invention, in the negative pressure stabilized casting mold of flowable binder-free material, particularly quartz sand, the negative pressure takes place in the backfilling mass. However, in the interior of the foamed synthetic plastic form a normal pressure or even a certain negative pressure depending upon the foaming process in the closed individual cells of the foamed synthetic plastic body takes place. Thereby, the foamed synthetic plastic form withstands the static loading through the backfilling mass and is not compressed by the same.

The vaporizable or burnable synthetic plastic form may be designed as a full or integral form of foamed synthetic plastic material. It is also possible that it is composed of plates constituted by foamed synthetic plastic material which plates together form a hollow space wherein a suitable air pressure is provided. The latter also ensures that the negative pressure-stabilized backfilling sand will not be compressed.

In order to improve separation of normal pressure in the foamed synthetic plastic form from the negative pressure in the binder-free backfilling mass, the foamed synthetic plastic form, especially formed by plates and bars as a hollow form, is outwardly coated by a synthetic plastic foil.

This purpose can also be attained in a different manner. In accordance with another inventive feature, the form is coated by grained material having small particles and mixed with warm-hardenable or cold-hardenable binding material. After vaporizing or burning-out of the synthetic plastic form, this mixture forms the outer surface or wall of a hollow of the mold. Such a shell is more or less thick, in dependence upon the dimension of the form and the characteristics of the molten metal, especially its temperature. In such a method, the utilization of negative pressure in the backfilling material is not necessary in many cases.

When the lost synthetic plastic form is coated with a refractory coating resistant to the molten metal, it is further proposed to heat the binder-free sand before pouring of the molten metal. The heating acts for vaporizing of the synthetic plastic form so that the vaporization is not performed only by introducing the molten metal. When the temperature of the binder-free mold material is not sufficient for full or partial vaporization of the synthetic plastic form, then the heated casting mold causes good flowing out of the molten metal, since it is only insignificantly cooled by the mold.

The heating of the binder-free mold material can be performed so that the heated binder-free mold material is brought onto the coated lost form. It is also possible to bring the binder-free mold material to conventionally utilized temperatures in the casting box or the like casting containers and to heat it in the latter. This may be performed by flame heating or by electric heating.

When the binder-free backfilling mass in heated state is applied to the lost form provided with the shell, it is recommended to perform this in a casting box or container which is under vacuum, whereby the pressure acting upon the form is not so high.

In accordance with a further feature of the invention, after pouring of molten metal when hardening of a cast part starts, a portion of the binder-free mold material is withdrawn from the casting box. This withdrawal has the purpose of avoiding stresses caused by shrinkage of the cast parts. The withdrawal of the binder-free mold material is performed advantageously from inner regions of a hollow box-shaped cast part. The thus-withdrawn binder-free mold material which is heated by the molten metal is suitable for bringing into a next casting mold before casting. Thereby the synthetic plastic form of the next casting mold is either burned out or vaporized, or heated as described so that the molten metal is not significantly cooled and flows well. In accordance with this method it is possible to cast relatively thin-walled parts of metals which do not have high flow characteristics.

The withdrawal of the binder-free mold material after sufficient hardening of the cast part so as to maintain the cast contours, can be attained by various means. For example, this can be attained by providing lateral or bottom openings in the casting box. Especially advantageous is the withdrawal by aspiration.

The inventive method is especially utilized in connection with the foamed synthetic plastic form provided with fibers which increase the rigidity of the cast part. These fibers, particularly formed as a fabric with sufficient distance between weft fibers and warp fibers, can be constituted of carbon fibers which are utilized as reinforcement in manufacture of synthetic plastic materials. The fibers can be mineral fibers. Finally, metallic fibers may be provided. For example, when an alloy of aluminum is utilized, fibers or wires of a fine steel may be provided. Regardless of the dimensions and thickness of the cast part to be manufactured, this fabric and especially the wire, has the thickness of the reinforcement mats.

When a foamed synthetic plastic form or foamed synthetic plastic plates with interposed wires, fabric or mats of metal are provided, the wires, fabric or mats are electrically heated, in accordance with a further inventive feature, before casting of metal, so that the foamed synthetic plastic material is vaporized or burnt-out. When the electric heating is not so strong as to fully burn-out the lost synthetic plastic form, the heating acts to ensure that the molten metal will not be so quickly cooled and thereby has good flowing characteristics.

In accordance with the invention simple means are utilized for manufacturing of very complicated and especially thin-walled cast parts. For example, a ship hull having a length over 10 m of an aluminum-silicon alloy may be manufactured, and advantageously reinforcement from wires or a fabric of rust-proof steel may be utilized. For manufacturing of forms, the plates or foils of synthetic plastic material or foamed synthetic plastic material are utilized between which the reinforcement is arranged. After manufacturing of the lost form the latter is coated by a refractory mass. Finally, the backfilling material with binder-free mold material follows the coating. Advantageously after or during the filling, a negative pressure takes place in the binder-free mold material.

Finally, the binder-free mold material is heated. The heating can be performed with the aid of tubular conduits located inside the binder-free mold material, and fillable by highly heated air, for example to 1000°C. In addition to or independently of this, the reinforcement wires or mats of steel are subjected to current, so that they are heated and thereby the synthetic plastic material is burnt out, or vaporized, or heated to prevent cooling of the molten metal poured into the mold.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a perspective view of a lost form of synthetic plastic material, in accordance with the present invention;

FIG. 1A is a view showing a vertical section of another hollow form;

FIG. 2 is a view showing a vertical section of a casting mold;

FIG. 3 is a section taken along line III—III of FIG. 2;

FIG. 4 is a view showing a vertical section of a further casting mold;

FIG. 5 is a section taken along line V—V of FIG. 4;

FIG. 6 is a section taken along line VI—VI of FIG. 4;

DESCRIPTION OF PREFERRED EMBODIMENTS

Figure 7:
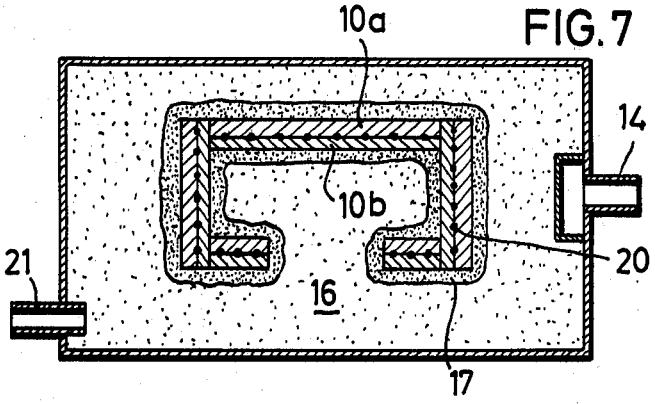
FIG. 7 is a view showing a vertical section of still a further casting mold.

FIGS. 1 and 1A show a form of foamed synthetic plastic material. In accordance with FIG. 2 the form of FIG.1, arranged in a casting box 11 which is closed from above by a cover plate 12. The cover plate may be constituted of a film of synthetic plastic material, and also of a sheet material. An inlet portion 13 with a pouring-in funnel 14, both constituted of a foamed synthetic plastic material, are arranged on the form 10. The casting box 11 has at its side a suction tube 15 and a filter 15*a*. A vacuum pump is connected with the suction tube 15 so that a binder-free backfilling material 16, particularly quartz sand, is under a negative pressure.

Since the closed cells of the foamed synthetic plastic material of the form 10 are under a normal pressure, the backfilling material which is under the negative pressure exerts only a small static pressure upon the form, so that the contour of the latter remains unchanged. The molten material is supplied in the direction of the arrow through the pouring-in funnel 14. It evaporizes the foamed synthetic plastic material and replaces the same. During this casting process the backfilling material 16 is under negative pressure. The negative pressure remains stable so that when the vacuum pumps operates during the casting process the products of combustion of the foamed synthetic plastic material are carried away through the funnel 14 and thereby can be so treated as to cause no problems.

FIG. 3 shows that the negative pressure in the binder-free material leads to such consistency that the utilization of special cores is not necessary, since the negative pressure imparts sufficient rigidity to the binder-free filling material.

FIG. 4 shows that the form 10 of the foamed synthetic plastic material is coated by a refractory mass. In other words, it is a coating of a known composition, which withstands the action of casting molten material. In the case of a low meltable alloy, such as aluminum, this coating mass may be constituted of gypsum, especially foamed gypsum. It is also possible to utilize mixtures of materials known in fine casting processes, which can be applied in especially effective and technically simple manner as coating on the lost form before enveloping of the same by the binder free material 16. The coating may have a low but also a higher gas permeability, whereas the gas impermeability of the lost form 10 due to the closed pores provides pressure a differential between the form and the binder-free backfilling material. The refractory coating can be produced by spraying, brushing or dipping of the form in a liquid or paste-like coating material. The coating, additionally to the binding material containing the same, is under negative pressure. The gas permeability of the coating leads to problemless casting. The form of the foamed synthetic plastic material of FIG. 4 further has an insulated or exothermic feeding insert. The latter may be formed as a hollow ball-shaped feeder 18 which is not provided with a coating 17.

The form of foamed synthetic plastic material may also be coated by a foil of a synthetic plastic material which during the contact with the molten metal within binder-free loose sand such as quartz sand, forms a crust, whereas the foil acts as a binder medium.

The casting inlet 13 with the pouring-in funnel 14 is formed by a hollow thin-walled tube of synthetic plastic material. It is also coated. Since the plate 12 is constituted of synthetic plastic foil, it overlaps the casting funnel from above. It is especially advantageous to provide a baffle of a thin metal lamella 19 which melts first when the casting funnel is filled with the liquid metal. Thereby the negative pressure is maintained in the mold. Similarly, the cylindrical funnel insert 18 is closed from above by the foil.

FIG. 5 shows the heating elements 19*a* are arranged in the binder-free backfilling material 16. They may be formed by tubes through which hot air flows. They also may be formed as electrically resistant rods.

FIG. 6 shows that the tubes 19*b* may be formed as components of the casting box.

FIG. 7 shows in proportion that the form 10 is assembled from plates 10*a* and 10*b* of foamed synthetic plastic material between which fibers, wires, or fabric of carbon filaments, mineral fibers, or metallic wires are arranged. When for example an aluminum casting alloy is utilized, it is recommended to utilize fibers fabric of carbon fibers or of fine steel. Thereby the foamed synthetic plastic model is reinforced by fibers, wires and the like. Since later the foamed synthetic plastic material is replaced by the molten metal, indirectly or directly, the fibers, wires and the like reinforce the cast part. Such a reinforcement is advantageous when the casting material does not have high mechanical fluidity as, for example, in the case of well meltable aluminum-silicium alloy. In such cases it is recommended to utilize reinforcement from carbon fibers or advantageously a fabric or fine steel. The alloy is, however, advantageous for other metallic materials. Thus, for example, the alloy of cast iron has a reinforcement of steel. The thus obtained reinforcement of the cast part is independent of the coating of the lost form or the utilization of negative pressure in the backfilling material 16.

The lost form 10*a*, 10*b* in FIG. 7 is also provided with a coating. In accordance with the embodiment shown in this figure the wires constituted of metal are so heated electrically that the foamed synthetic plastic material is vaporized or burnt out. The thus-produced hollows are maintained by the coating 17. When the synthetic plastic material is not vaporized, the casting material is poured into the form.

In order to obtain unimpeded shrinkage of the cast member after the casting, the binder-free material 16 is aspirated through a suction conduit 21 and applied to a following casting box. This contributes to heating of the binder-free backfilling material in the next casting box so as to vaporize or burn out the embedded lost form of synthetic plastic material. In this case the special heating means shown in FIGS. 5 and 6, for heating already filled backfilling material, is no longer necessary.

Figure 8:
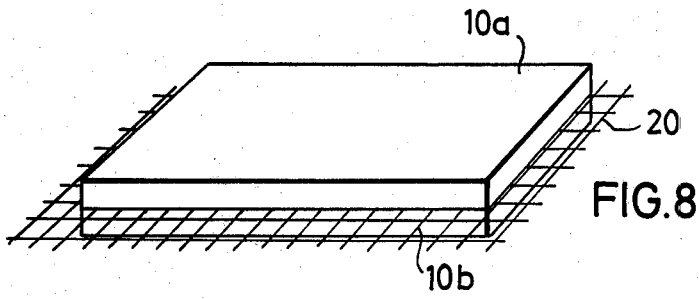
FIG. 8 is a perspective view of two synthetic plastic plates with interposed fibers.

FIG. 8 shows that the lost form of synthetic plastic material is assembled from the plates 10*a* and 10*b*, and a reinforcing mat of steel wires is located therebetween. The plates 10*a* and 10*b* are glued to one another.

Figure 9:
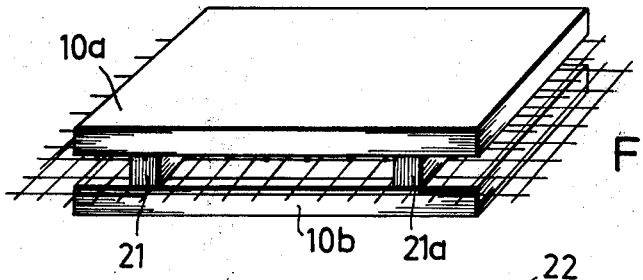
FIG. 9 is a perspective view of two foamed synthetic plastic plates spaced from one another, with interposed fibers.

FIG. 9 shows that the plates 10*a* and 10*b* are arranged at a distance from one another, and rods 21 and 21*a* of foamed synthetic plastic material are located therebetween. Mats of fibers or wires are located on sides of the plates, the sides facing toward one another, whereby two such mats are arranged at a distance from one another. Several such layers may be provided in a respectively designed lost form. The plates of synthetic plastic material located one above the other advantageously overlap the reinforcing mats.

Figure 10:
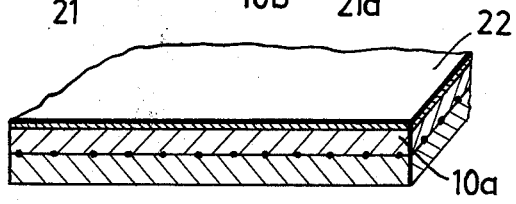
FIG. 10 is a perspective view of two foamed synthetic plastic plates with interposed fibers and an outer coating layer of a synthetic plastic foil.

FIG. 10 shows that the foamed synthetic plastic plate 10*a* having a contour corresponding to that of the lost mold, is provided with a synthetic plastic foil 22. The latter leads to a very smooth outer surface of the cast part regardless of whether no coating is provided as shown in FIG. 2, or an additional coating 17 is provided as shown in FIG. 4. This foil of synthetic plastic material is simultaneously a "separating wall" between the backfilling material which is under negative pressure, and the form of foamed synthetic plastic material, when a negative pressure is utilized, which is not necessary in many cases.

It will be understood that each of the elements described above, or two or more together, may also find a useful application in other types of constructions, differing from the types described above.

While the invention has been illustrated and described as embodied in a method of manufacturing a hollow casting mold, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of manufacturing of a casting mold, comprising the steps of forming a casting mold body of a flowable binder-free backfilling mass; stabilizing the casting mold body by negative pressure; providing in said body a lost form of synthetic plastic material; withdrawing a portion of the binder-free backfilling mass, after pouring of molten metal and during beginning of hardening of the cast part.

2. A method as defined in claim 1, wherein said withdrawing step is performed by aspiration.

3. A method as defined in claim 1, wherein said withdrawing step includes supplying of the binder-free mass withdrawn in heated state from the heated mold, to a further such mold with a further such lost form.

4. A lost form for a casting mold of a negative-pressure stabilized flowable binder-free backfilling mass, comprising plate elements of synthetic plastic material having faces which face toward one another; and an intermediate web-like element provided on said faces.

5. A lost form as defined in claim 4, wherein said plate elements are constituted of foamed synthetic plastic material.

6. A lost form as defined in claim 4, wherein said intermediate element is a fabric.

7. A lost form as defined in claim 4, wherein said intermediate element is formed by fibers.

8. A lost form as defined in claim 4, wherein said intermediate element is formed by carbon.

9. A lost form as defined in claim 4, wherein said intermediate element is formed by mineral filaments.

10. A lost form as defined in claim 4, wherein said intermediate element is formed by metallic fibers.

11. A lost form as defined in claim 4, wherein said intermediate element is formed by metallic wires.

12. A method of manufacturing a casting mold, comprising the steps of forming a casting mold body of a flowable binder-free backfilling mass; stabilizing the casting mold body by negative pressure; providing in said body a lost form of synthetic plastic material by arranging plates of synthetic plastic material adjacent to one another and having faces facing towards one another and provided with an intermediate web-like element; and heating the backfilling mass before pouring a molten metal in the lost form by incorporating heating elements in the binder-free backfilling mass.

* * * * *